US006785506B2

(12) United States Patent
Kato et al.

(10) Patent No.: US 6,785,506 B2
(45) Date of Patent: Aug. 31, 2004

(54) FIXING MEMBER HAVING LAYERS WITH RADIATION-TRANSMITTING AND RADIATION-ABSORBING PROPERTIES, AND A FIXING ASSEMBLY INCLUDING SUCH A FIXING MEMBER

(75) Inventors: Motoi Kato, Shizuoka (JP); Kenya Ogawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 10/173,608

(22) Filed: Jun. 19, 2002

(65) Prior Publication Data

US 2003/0002895 A1 Jan. 2, 2003

(30) Foreign Application Priority Data

Jun. 21, 2001 (JP) ..... 2001/188743

(51) Int. Cl.[7] ..... G03G 15/20
(52) U.S. Cl. ..... 399/333
(58) Field of Search ..... 399/333, 328; 219/216

(56) References Cited

U.S. PATENT DOCUMENTS

| | | | | |
|---|---|---|---|---|
| 5,508,796 | A | 4/1996 | Sasame et al. | 355/271 |
| 5,543,904 | A | 8/1996 | Kato et al. | 355/285 |
| 5,552,582 | A | 9/1996 | Abe et al. | 219/619 |
| 6,151,477 | A | 11/2000 | Takeuchi et al. | 399/318 |
| 6,345,169 | B1 | 2/2002 | Haneda et al. | 399/328 |
| 6,442,365 | B1 * | 8/2002 | Schlueter, Jr. et al. | 399/328 |

* cited by examiner

*Primary Examiner*—Quana Grainger
(74) *Attorney, Agent, or Firm*—Fitzpatrick, Cella, Harper & Scinto

(57) ABSTRACT

A fixing member having the form of a film or belt which is multi-layer constructed to have at least a base layer and a surface layer. The base layer is formed of a material having radiation-transmitting properties, capable of transmitting radiation coming from a radiation source disposed on the back side of the base layer in non-contact with the fixing member. Also disclosed is a fixing assembly having this fixing member and a radiation source disposed on the internal side of the fixing member. Even though the radiation source is disposed on the internal side of the fixing member, the fixing member can perform good surface heating in a good heat response.

40 Claims, 6 Drawing Sheets

FIXING MEMBER HAVING LAYERS WITH RADIATION-TRANSMITTING AND RADIATION-ABSORBING PROPERTIES, AND A FIXING ASSEMBLY INCLUDING SUCH A FIXING MEMBER

BACKGROUND OF THE INVENTION

1. Field of the Invention

This invention relates to a fixing member used to fix toner images in image-forming apparatus of an electrophotographic system, and a fixing assembly making use of the fixing member.

2. Related Background Art

As a problem having become more important in recent years in image-forming apparatus of an electrophotographic system such as copying machines, printers and those used in facsimile machines, there may be given how demands for what is called energy saving be coped with. Conventional toner image fixing assemblies used in such apparatus are of a system in which toner is melted and then fixed to paper, and hence they consume electric power directly as heat energy. Such electric power occupies a great part of the electric power consumed in the whole main body of the apparatus.

To cope with this, as one directionality toward the reduction of power consumption of fixing assemblies, it is attempted to make on-demand operation (real-time operation in which usually no electric current is flowed to a heater and the heater is turned on only at the time of, e.g., image formation). Stated specifically, a fixing member is made in the form of a thin-wall roller, a thin belt or a film so that the heat capacity can greatly be made smaller than that of conventional thick-wall heating rollers to enable quick rise of the assembly and at the same time cut down power consumption during that time. Making such on-demand operation enables the printing to be quickly started upon receipt of printing signals almost without any wait time. Hence, it is unnecessary to keep the fixing member warm at a high temperature around the printing temperature even at the time of non-printing as done in the case when conventional heating rollers are used, and it can be enough only to keep at normal temperature or at most an appropriate low temperature. The dissipation of heat at the time of keeping the fixing member warm increases in proportion to the difference in temperature between environmental temperature and fixing member's preset temperature. Because of such heat dissipation, the electric power is always consumed even in the state of non-printing. Accordingly, in a variable situation where the printing is intermittently repeated, making the fixing assembly on-demand operable can bring about a very great effect of power saving.

The on-demand operation can also contribute to energy saving on the following points, too. The fixing of toner images is chiefly performed by heating them with a heater from the inside of a heat fixing member which is commonly of a roller type. In a system making use of a halogen lamp as a heat source and a fixing roller as the fixing member, the glass surface temperature of the halogen lamp reaches a high temperature of 400° C. or more. Actual fixing temperature, however, is regulated at about 180° C. by detecting the surface temperature of the fixing roller. On the other hand, in an on-demand system making use of a ceramic heater and a fixing film, the same fixing performance as that in the above system making use of a fixing roller is achievable in the state the heater temperature is set to approximately from 190° C. to 200° C. This means that the latter system, in which the top temperature of the heater can be lowered to about fixing temperature, causes less heat dissipation loss and enables more efficient heating, than the former system. In addition, a surface heating system in which the fixing member is heated on its side coming into contact with paper or the like is advantageous in respect of heat response and also in view of heat efficiency, over an internal heating system in which, as fixing speed is made higher, the fixing member has a higher temperature on the inside and the roller has a lower surface temperature as in the case of conventional roller fixing.

As a system in which the fixing member itself effects self-generation of heat, a system is also known which makes use of, e.g., a self-heating element (such as a resistance heating element) or a magnetic-induction heater. According to such a system, the top temperature can be lowered, and it is a highly efficient system. Also, according to this system, the fixing member can directly be heated at the part vicinal to its surface, and hence the heat response is improved and, compared with the roller fixing system operated by usual halogen lamp heating, stable temperature control can be made with small ripples, making it possible to take latitude effectively between a high-temperature offset region and a low-temperature offset region. Then, as the result, stable images can be formed which are free of any uneven gloss and in a high fixing performance.

In what is called a surf system, which makes use of a film as the fixing member, it is difficult to fix color toner images in a good state as explained below, and, because of use of a thin-layer film, it is difficult to achieve uniform fixing performance especially in forming color images having toners in a large quantity on a transfer medium. There have been such problems. In the fixing of color toner images, toner images may melt in different ways in accordance with any unevenness of paper surface when the images are formed on plain paper. This may cause uneven gloss in the surface of fixed images, or, where a film for OHP (overhead projector) is used as the transfer medium, tends to make the transmittance of OHP images different in accordance with any differences in toner image layer thickness, and it has been difficult to obtain high-grade images.

Accordingly, in order to smooth the surface of fixed images, it is also possible to provide the fixing film with an elastic layer at minimum, like that in conventional roller fixing. For example, the film may be provided with an elastic layer of 100 to 300 $\mu$m thick, formed of silicone rubber or the like. However, in conventional surf fixing, the fixing film is brought into contact with a heat-generating source such as a ceramic heater on the back of the film to heat the film by contact conduction over a nip distance of 4 to 6 mm at most. Hence, providing the film with an elastic layer having the above thickness has caused a problem that the film has a slow heat response. This problem may more seriously occur in the fixing of color toner images formed of toners with different colors, superimposed mutually in a plurality of layers, because a large quantity of heat flow is required therefor. Where the film is provided thereon with the above elastic layer, the heat flow coming from the heater can not sufficiently come through the film surface during the time an image-fixing medium such as paper passes through the nip, so that only the toner surface layer may be melted to tend to cause faulty fixing.

In such a case, the fixing performance can be improved by making the heater temperature higher. However, the film, the elastic-layer inner face and the heater holder are exposed to high temperature to undergo damage such as thermal deformation, resulting in a shorter lifetime.

As a countermeasure therefor, one may contemplate incorporating a filler in the elastic layer in order to improve heat conduction of the elastic layer formed of silicone rubber or the like. However, the rubber may increase in hardness to decrease in elasticity, so that the effect attributable to the providing of the film with the elastic layer may be damaged. For the reasons as stated above, it is actually not easy to construct the surf system especially for color-image fixing assemblies.

SUMMARY OF THE INVENTION

Accordingly, an object of the present invention is to provide a fixing assembly having been made on-demand operable which can heat a fixing member in a good efficiency, and also can perform good surface heating in a good heat response and can well fix color images which require a high heat utilization efficiency, even though a radiation source is disposed on the internal side of a heat fixing member.

Another object of the present invention is to provide a fixing assembly which can form good color images free of any uneven gloss and in a stable fixing performance, can make the assembly compact and may cause less heat dissipation loss, promising superior economical advantages.

The above objects can be achieved by the invention described below. That is, the present invention is a fixing member used to fix toner images, having the form of a film or belt which is multi-layer constructed to have at least a base layer, an intermediate layer and a surface layer; the base layer at least being formed of a material having radiation-transmitting properties, capable of transmitting radiation coming from a radiation source disposed on the back side of the base layer in non-contact with the fixing member, and the surface layer or intermediate layer being formed of a material having radiation-absorbing properties.

With the above construction, the radiant light coming from a radiant-light source serving as a heat source provided on the back can reach the vicinity of the film or belt surface, and the toner images transported to the part of the film or belt surface can effectively be heated.

DESCRIPTION OF THE PREFERRED EMBODIMENTS

Figure 1:
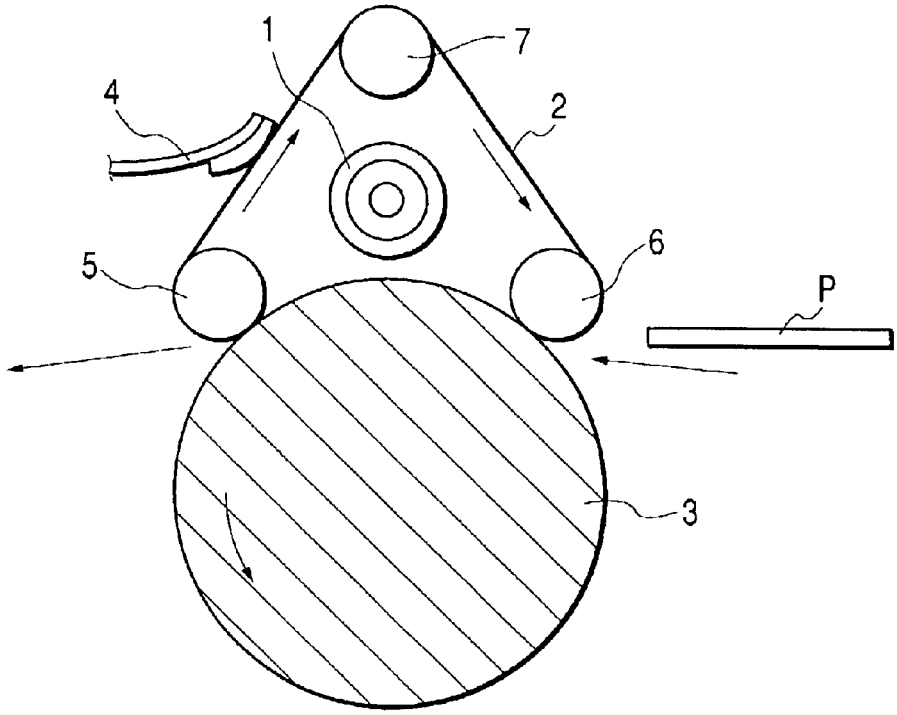
FIG. 1 illustrates the whole construction of a fixing assembly according to a first embodiment of the present invention.

The present invention is described below in detail by giving preferred embodiments of the present invention. To solve the problems the related background art has had, the present inventors have first considered that, in order to provide the fixing assembly of an on-demand system which can well fix even color images, not the method in which the fixing member is heated by contact conduction of heat but a method in which a film or the like as a fixing member is directly heated on its surface on the side coming into contact with an image-fixing medium such as paper or plastic sheet is effective as the method of heating the fixing member used, and brings about a great improvement in heat response of the fixing member. In this regard, as the method of surface-heating the fixing member such as a roller and a belt, available are the method making use of a self-heat-generating means such as a resistance heating element as stated previously, and a method in which the fixing member is surface-heated by contact or radiation by means of a non-contact external heating source. These methods, however, involve a large heat dissipation loss to the outside. Accordingly, the present inventors have considered that, if a heating source is disposed on the internal side of the fixing member and yet the fixing member can be surface-heated by means of such a heating source, the heat utilization efficiency can be improved to make it also possible to fix color toner images which require a large quantity of heat.

Now, the present inventors have had an idea on the construction of a glass roller known on its principle for more than twenty years, and made studies on a surface-heating method in which the surface of a film or the like coming into contact with the image-fixing medium such as paper at the time of fixing is directly heated by radiation heat coming from a heating source disposed on the internal side of the fixing member. As the result, it has been found that, although glass materials themselves used in the glass roller are preferable because of their some good radiation-transmitting properties over the visible region to the near infrared region, there is a problem on their use in general products because of their another problem that glass may break to be damaged. Also, glass has its limit for making ultrathin, and is a material not suited for making it have low heat capacity. Thus, it has been necessary to make development of more favorable materials. As a result of extensive studies made on materials which can replace these, the present inventors have discovered that a fixing member having novel multi-layer construction may be used which comprises a fixing film comprised of a polyimide resin or the like having a high heat resistance and high radiation-transmitting properties, used as a base layer, and optionally formed thereon a transparent elastic layer having an elasticity, radiation-transmitting properties and heat insulation properties, and further formed thereon a surface layer which may preferably have releasability and radiation-absorbing properties, and this can provide a fixing assembly of an on-demand system which can well fix even color toner images and has superior economical advantages. Thus, they have accomplished the present invention.

More specifically, in the present invention, a radiation source is disposed on the base layer side of the fixing member having the above multi-layer structure (hereinafter "back side of the fixing member") and the assembly is so constructed that the radiation from the radiation source is transmitted through the base layer and elastic layer to thereby make the surface layer of the fixing member absorb the radiation directly so that the surface of the fixing member is heated. Thus, the heat response and heat utilization efficiency have been improved to achieve fixing in a good efficiency and in a good state.

The present invention is described below in greater detail by giving preferred embodiments.

(Embodiment 1)

FIG. 1 is a schematic sectional view of a fixing assembly of this Embodiment. A fixing belt (a tubular member of 45 mm in diameter) 2 is put over transport rollers (10 mm in diameter, made of hollow aluminum having a thickness of 1 mm) 5, 6 and 7 in substantially a triangular form. At about the center of its interior, a halogen lamp (6 mm in diameter) 1 having electric power rating of 100 V and 800 W is disposed as a radiation source. As shown in FIG. 1, a back-up roller (40 mm in diameter) 3 which is a press member pressed against the fixing belt is brought into pressure contact with the belt extending between the transport rollers 5 and 6 so that tension pressure is applied at a curved nip formed between the fixing belt 2 and the back-up roller 3. As the back-up roller 3, a sponge roller which is a little hard for the purpose of heat insulation is used as a base, having thereon a surface layer provided with a 50 μm thick PFA (tetrafluoroethylene-perfluoroalkyl vinyl ether) heat-shrinkable tubing in order to impart releasability. Then, the fixing belt 2 and the transport rollers 5, 6 and 7 are so constructed as to be follow-up rotated as the back-up roller 3 is rotated.

To the fixing assembly constructed as described above, an image-fixing medium P such as a paper sheet on the top surface of which unfixed toner images have been formed is transported as shown by an arrow, whereupon the fixing belt 2 is surface-heated at the nip by the radiation of the halogen lamp 1. The fixing belt 2 thus heated is further pressed against the toner surface at the nip by the action of the tension produced by the transport rollers 5, 6 and 7 and the back-up roller 3, so that the toner is quickly melted over a wide range extending from the transport roller 5 to the transport roller 6 and at the same time the toner thus melted is anchored to the image-fixing medium P, thus the toner images are well fixed. Here, for the purpose of temperature control, a thermistor 4 is brought into contact with the peripheral surface of the fixing belt 2 to detect its temperature, on the basis of which the amount of radiation from the halogen lamp 1 is regulated to make PID (proportional integral and differential) control so that the surface of the fixing belt 2 is kept at a constant temperature.

As another method which is a modification of the above temperature control, a method is available in which, e.g., the thermistor 4 is brought into contact with the fixing belt 2 on its back side at the nip in its paper feed or paper non-feed zone extending in the lengthwise direction, to detect temperature at this part, and the amount of radiation on the fixing belt 2 is regulated to make PID control so that the surface of the fixing belt 2 is kept at a constant temperature. In this case, the non-contact area of the thermistor may be kept to have radiation-reflecting properties or may be coated with, e.g., aluminum foil. This is preferable because the actual temperature of the internal face of the fixing belt 2 can be detected with ease.

Figure 2:
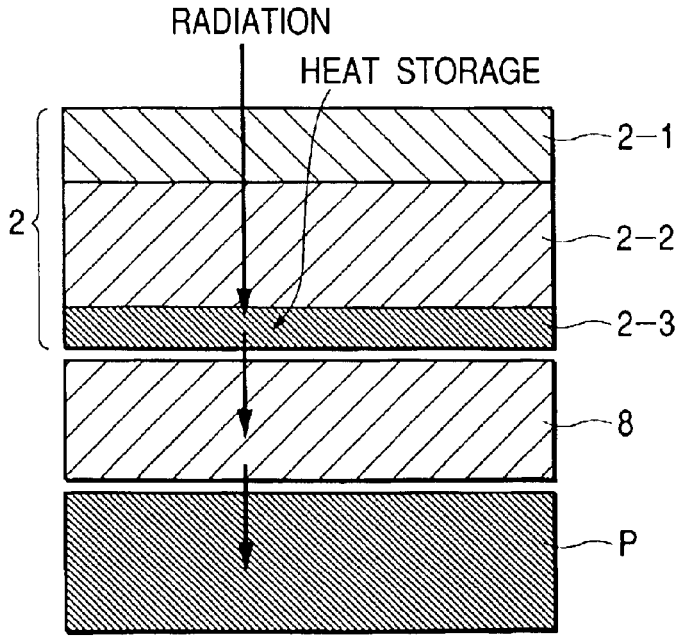
FIG. 2 illustrates how radiation and heat act in a fixing belt of Embodiment 1.

FIG. 2 shows the layer construction of the fixing belt 2 used in this Embodiment. The the fixing belt 2 used in this Embodiment is formed using a 50 μm thick polyimide film as a base layer 2-1, to the surface of which a 200 μm thick LTV (low-temperature vulcanizing) silicone rubber layer is laminated as an elastic transparent heat-resistant member to provide an intermediate layer 2-2. The base layer 2-1 may have a thickness of from 0.01 mm to 0.5 mm, within the range of which the belt can have a flexibility and can provide an enlarged nip zone, though the back-up roller 3 has a small diameter, to bring about an improvement in fixing performance. If it has a thickness of less than 0.01 mm, film strength may be lost to make it difficult for the belt to be stably driven. At the same time, its heat insulation properties may also be lost, and hence the belt may be affected by the temperature of the transport rollers 5 and 6 and air layer which are present on the internal face of the belt, so that the temperature may rise with difficulty when, e.g., the fixing assembly is started to drive. If on the other hand the base layer has a thickness of more than 0.5 mm, its flexibility may be lost and the nip zone may decrease to cause a lowering of fixing performance. At the same time, its radiation-transmitting properties may also exponentially decrease, and hence the radiant light reaching the belt surface layer may decrease, so that the effect intended in the present invention may no longer be obtained.

Next, as the thickness of the intermediate layer 2-2, it may preferably be within the range of from 50 μm to 1,000 μm, more preferably from 50 μm to 500 μm, and still more preferably from 200 μm to 500 μm, within which the intermediate layer may appropriately be provided. More specifically, if the intermediate layer is thinner than this range, the effect of providing the elastic layer as the intermediate layer is not well obtainable. It it is too thick, the rise speed may lower undesirably.

The fixing belt 2 used in this Embodiment is so constructed as to have a surface layer 2-3 which is further provided on the intermediate layer 2-2. The surface layer 2-3 is formed as a black-color coat layer of about 20 μm thick, using a coating material prepared by dispersing carbon particles with an average particle diameter of 0.1 μm or less, having radiation-absorbing properties, in a fluorine resin such as FEP (fluorinated ethylene propylene resin), having heat resistance and releasability. Materials usable in the present invention to form the surface layer are by no means limited to the foregoing, and fluorine resins such as PFA, PTFE (polytetrafluoroethylene) and ETFE (ethylene-tetrafluoroethylene copolymer) may be used. The carbon particles dispersed in the fluorine resin are also by no means limited thereto, and any materials may be used as long as they are materials having radiation-absorbing properties.

In the fixing belt 2 used in this Embodiment, constructed as described above, the intermediate layer 2-2 has elastic properties, and hence the thin-layer surface layer 2-3 superposed thereon also has surface follow-up properties after that layer, even against the surface of a multi-color superimposed color toner image 8, having unevenness. As the result, the heat is conducted all over the color toner image surface, and a high fixing performance on the image-fixing medium P such as paper is materialized.

Here, in this Embodiment, a halogen lamp used in usual roller fixing is used as the radiation source. About 80 to 90% of the radiation energy from such a lamp is held by that of the infrared region. Accordingly, such a lamp may preferably be used as an inexpensive and well efficient radiation source.

In the present invention, however, without any limitation thereto, an infrared heater such as a carbon lamp may also be used as a radiant-light source. Besides, a xenon lamp, though its radiation is rather in a higher proportion for the visible light region, may effectively be used in the present invention.

Figure 5:
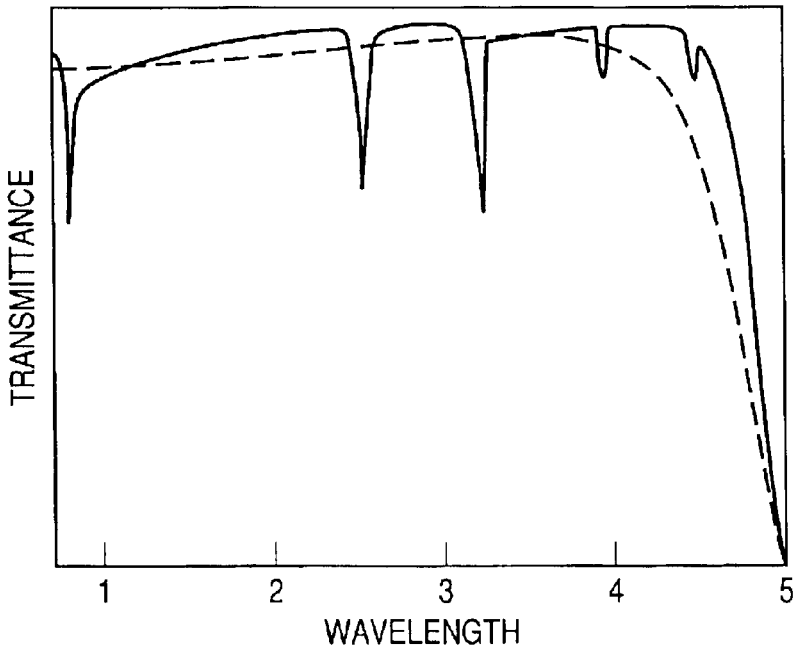
FIG. 5 shows infrared transmittance of a fixing belt in the present invention.

The reason why the fixing belt 2 used in this Embodiment is made to have the above layer construction is explained below. First, the polyimide resin used in the base layer has a high heat resistance, but has an inferior transmitting properties in respect of its radiation-transmitting properties in the near infrared region, compared with quartz or heat-resistant glass (broken line in FIG. 5; transmittance: >90%). However, the glass can only be made thin-gage up to about 2 mm because of its problems such as mechanical strength and break, whereas the use of the polyimide resin can make the base layer thin-gage up to about 30 $\mu$m. Hence, its transmitting properties can be improved, and it has been made possible to attain 80% or more of transmittance (solid line in FIG. 5).

Making the base layer thin-gage can make the belt have a flexibility and can provide an enlarged nip zone, though the back-up roller 3 has a small diameter, to bring about an improvement in fixing performance as so stated previously. Moreover, heat-resistant engineering plastics such as polyimide resin are usually expensive, and hence constructing the belt in thin gage enables material cost to be cut down to achieve a cost reduction, too.

The polyimide resin also usually has a tinge of dark brown. Accordingly, one having transparency at a higher grade is more preferred in view of radiation-transmitting properties, though having a slightly inferior heat resistance, and may effectively used in the present invention. Besides, as base materials constituting the fixing member of the present invention, polyamide resins and aramid resins may also be used in the form of thin belts. The aramid resin has a little inferior heat resistance, but may be employed like the above polyimide resin.

In the fixing belt 2 used in this Embodiment, the transparent elastic layer comprised of LTV silicone rubber is formed on the base layer. This is because transparent-type materials such as RTV (room-temperature vulcanizing) or LTV silicone rubber has heat resistance, also having radiation-transmitting properties in the near infrared region which are comparable to or higher than the above materials for forming the base layer, and are suitable as materials for achieving the intended object of the present invention. In the present invention, the elastic layer may preferably be so formed as to have a JIS-A rubber hardness within the range of approximately from 5° to 40°.

Here, in order to obtain the effect of the present invention, not only the base layer but also the elastic layer must well transmit the light of infrared region. Here, infrared lamps such as the above halogen lamp have a valve (vacuum tube) comprised of quartz glass. As shown by a broken line in FIG. 5, the quartz glass absorbs infrared light with an wavelength of 5 $\mu$m or more and provides a small amount of radiation. Hence, the base layer and elastic layer of the belt may only transmit infrared light with an wavelength of 5 $\mu$m or less. Accordingly, in the present invention, what is important is the transmission of infrared light with an wavelength of from 0.7 $\mu$m at which effective heating begins in the infrared region, to 5 $\mu$m or less at which an infrared heater radiates light. If the base layer and elastic layer have a transmittance of less than 30% to infrared light with wavelengths of from 0.7 $\mu$m to 5 $\mu$m, any sufficient infrared light does not reach the belt surface layer to cause faulty fixing, or the belt base layer may be earlier heated than the surface layer to become wrinkled because of a decrease in strength, making it impossible to continue driving. Hence, in the present invention, the base layer and the elastic layer serving as a radiation-transmitting layer must have a transmittance of 30% or more to the infrared light with wavelengths of from 0.7 $\mu$m to 5 $\mu$m, and may preferably have a transmittance of 50% or more, and more preferably a transmittance of 80% or more. Here, the transmittance of infrared rays is measured by FT-IR (Fourier transmission infrared absorption spectroscopy) (Nexus 470, manufactured by Thermonicolet Co.) on test pieces prepared by providing the elastic layer on the belt base layer, and the transmittance measured is found as an average value with respect to wavelengths.

The surface layer formed on the elastic layer may also preferably be a layer having both toner releasability and radiation-absorbing properties. Stated more specifically, the surface layer must have a transmittance of 10% or less to the infrared light with wavelengths of from 0.7 $\mu$m to 5 $\mu$m, and may preferably have a transmittance of 5% or less. In the fixing belt 2 used in this Embodiment, the surface layer is formed with the black-color coat layer comprised of a fluorine resin with carbon particles dispersed therein as described previously. The surface layer substantially completely absorbs the infrared light having been transmitted (transmittance: 99.5%). In this Embodiment, the surface layer is formed by coating a fluorine resin. The surface layer is by no means limited to this. Without limitation thereto, in the present invention a method may also be used in which a carbon coating material is provided between the surface and the elastic layer by coating, or a fluorine resin sheet with carbon particles or the like added internally thereto is thermally compression bonded to the elastic layer.

Figure 3:
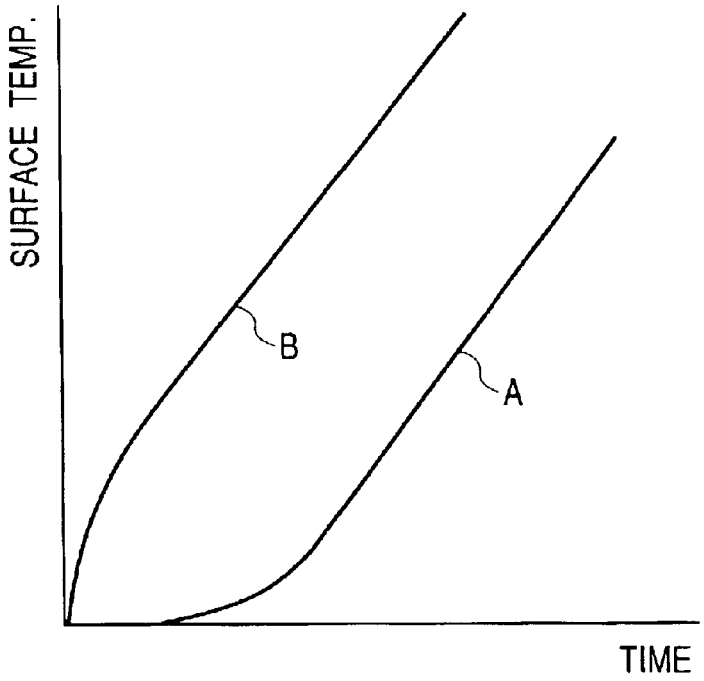
FIG. 3 is a graph showing a difference in heat response between surface heating (B) and inner-face heating (A).

The effect of surface heating is explained below with reference to FIG. 3. Where a carbon coating material layer is present on the surface of the base layer polyimide resin layer (film), shown by B in FIG. 3 (a state where the surface heating is performed), and where a carbon coating material layer is present on the back of the base layer polyimide resin layer, shown by A in FIG. 3 (a state where the inner-face heating is performed), it has been found that the former surface heating (B) enables quicker response in temperature rise response and driving start response when the fixing member is heated by radiation in a constant amount from its back as shown in FIG. 2, to measure changes with time of the surface temperature of the film, thus the effectiveness of surface heating has been ascertained. On the other hand, in the case of inner-face heating (A), as can be seen from FIG. 3 a delay in heat response is seen to a level of time constant of the whole film, which accompanies heat conduction from the inner face to the surface. In the case of the surface heating (B), it has been found that the initial rise is quick, and, with an increase in temperature difference between the surface and the inner face, the heat conduction from the surface to the inner face increases, drawing the same curve of temperature rise as the case of the inner-face heating (A).

More specifically, it has been ascertained that, when the polyimide is used in the base layer, the transparent LTV silicone rubber is used in the intermediate layer and the black-color coat layer provided as the surface layer using a fluorine resin with carbon particles dispersed therein is used as used in the present Embodiment and the radiation is applied from the back side (polyimide side), the response and temperature rise of the surface are more remarkable than the heat conduction from the back of the film as in the conventional roller fixing or surf fixing, and the radiant light directly heats the absorbing layer at surface (i.e., the surface layer) upon its transmission through the base layer and intermediate layer.

Figure 4:
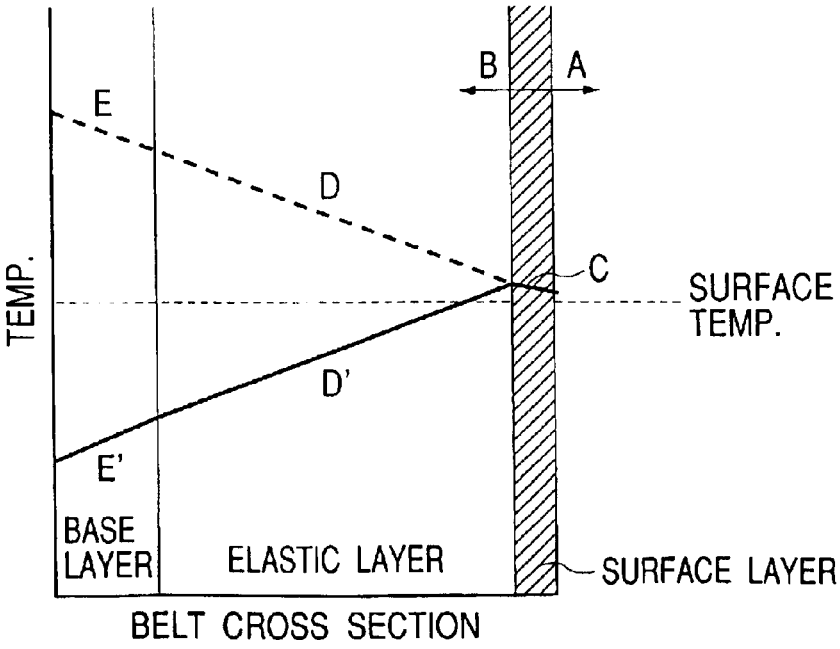
FIG. 4 is a view showing a difference between the temperature distribution of surface heating in the sectional direction of a fixing belt in Embodiment 1 and the temperature distribution of inner-face heating of the same belt but provided with a black-color absorbing layer on the back of the like belt

Temperature distribution in the belt in its sectional direction is described below with reference to FIG. 4. In respect of the fixing belt 2 (surface heating) used in this Embodiment and the fixing belt of inner-face heating, provided with black-color coating on the inner face of the fixing belt 2, a difference in temperature distribution between them in their sectional directions has been examined to find that the temperature distribution of inner-face heating in the state (C) that the surface temperature of the surface layer 2-3 of the fixing belt has come equal as a result of stationary radiation is in the order of the surface layer (C)/the intermediate layer (D)/the base layer (E) from lower temperature (shown by a broken line in FIG. 4), whereas that of surface heating in this Embodiment is in the order of the base layer (E')/the intermediate layer (D')/the surface layer (C) (shown by a solid line in FIG. 4).

More specifically, the temperature gradient in the sectional direction is directly opposite between the surface heating and the inner-face heating, and it is seen that, here, in the surface heating, the intermediate layer 2-2 acts thermally as a heat insulation layer to lower the inner-face temperature and contribute to the elongation of lifetime of the base layer and elastic layer. On the other hand, in the inner-face heating, it is seen that the intermediate layer 2-2 obstructs the conduction of heat from the heat source because of its heat insulation properties to act disadvantageously from the viewpoint of heating efficiency and low-temperature operation (i.e., long-lifetime operation).

In addition, to make examination from the viewpoint of heat conductivity, the radiant light is absorbed in the surface layer at its interface with the intermediate layer and converted into heat. Here, in order to make heat flow A on the surface layer side greater than heat flow B to the inner face, it is preferable to make the radiation-absorbing layer surface layer have a higher thermal conductivity than the thermal conductivity of the radiation-transmitting layer intermediate layer.

In this Embodiment, a layer made to have a thermal conductivity of 0.2 W/m·K or less without dispersing any filler in the silicone rubber is used as the intermediate layer, and a layer made to have a thermal conductivity of 0.6 W/m·K or more by dispersing carbon particles therein as the surface layer. The thermal conductivity is measured with a quick thermal conductivity meter (QTM-500, manufactured by Kyoto Denshi Kogyo K.K.).

Here, the radiation-transmitting layer intermediate layer 2-2 can be made to have heat insulation action by making it have a smaller thermal conductivity than the radiation-absorbing layer surface layer 2-3, whereby the fixing performance can be improved. Such heat insulation action of the intermediate layer, inclusive of that of the base layer, prevents the heat generated in the surface layer 2-3, from dispersing to the inner face of the belt, and enhances the efficiency of heat to the image-fixing medium P. In the meantime, the intermediate layer also acts as a heat storage layer in the course of fixing, at the time of pre-heating or at the part outside the nip, and its heat combines with the heat conducted to or stored in the surface layer 2-3 to bring about the effect of more improving fixing performance.

(Embodiment 2)

This Embodiment is a fixing assembly in which, as the fixing member, a radiation-transmitting elastic layer is formed on a radiation-transmitting film and a radiation-absorbing elastic layer and a release layer are additionally provided on the radiation-transmitting layer to have four-layer construction. Also, in this Embodiment, the transport roller is set as single-roller construction to drive the fixing member. Thus, with regard to the drive, it has greatly been simplified compared with the fixing belt 2 in Embodiment 1. The fixing member of this Embodiment is constructed in the form of a film. Ensuring the improvement in surface heat response like the case of Embodiment 1, any tension is not produced in the fixing film, and hence an improvement can be made with regard to the correction of what is called run-aside or meandering of the belt. Also, rollers may be in a smaller number, and a lower heat capacity can be achieved, than those in Embodiment 1. Hence, this is advantageous in order to start the fixing assembly at a high speed to drive, to achieve energy saving.

Figure 6:
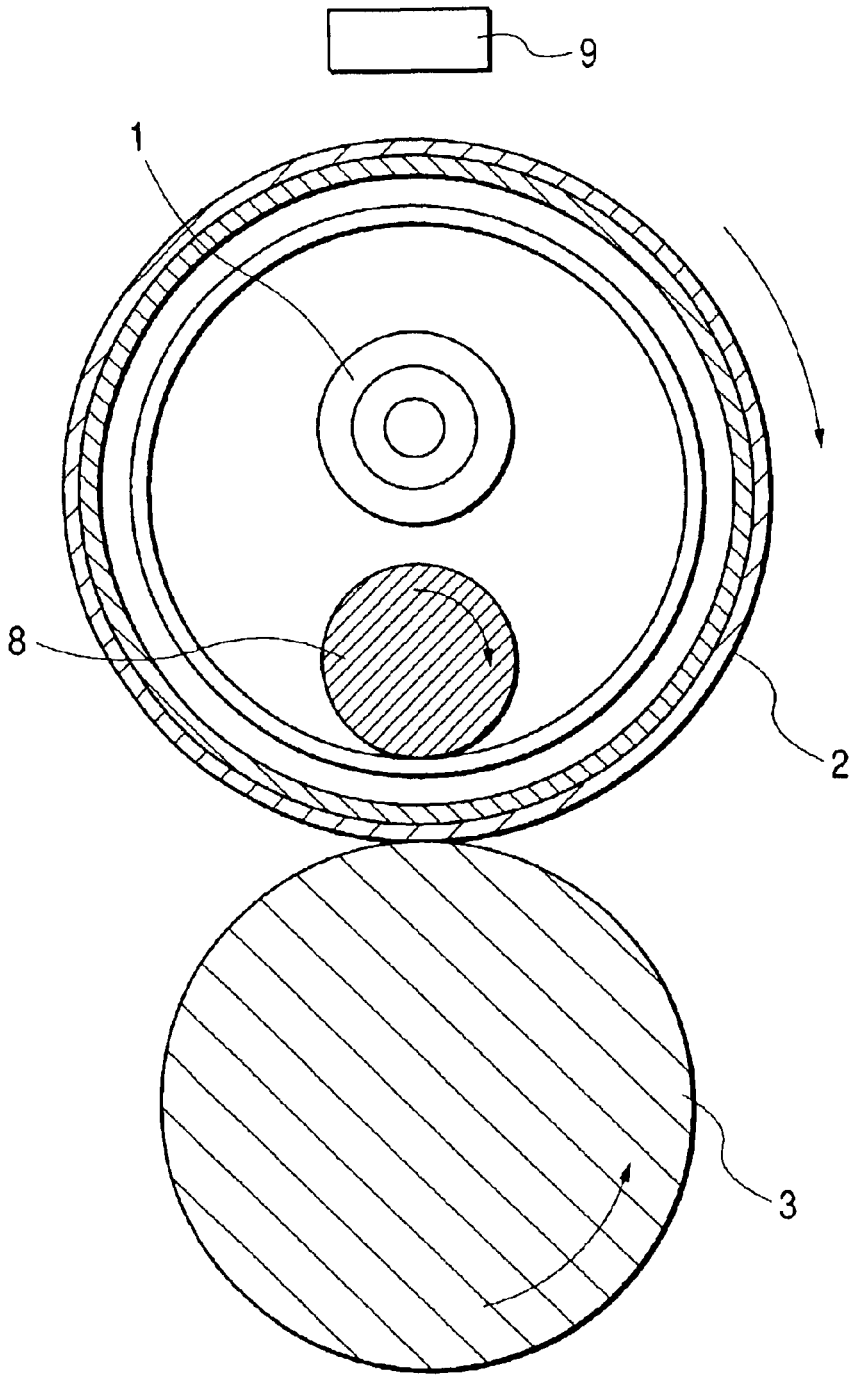
FIG. 6 illustrates the whole construction of a fixing assembly according to a second embodiment of the present invention as Embodiment 2.

FIG. 6 is a schematic view of a fixing assembly according to Embodiment 2, which is constituted of a fixing film 2 as a fixing member and a back-up roller 3; the former being provided surrounding a halogen lamp 1 as a radiation source. The fixing film 2 is pressed against the back-up roller 3 through a transport roller 8 to form a fixing nip. Here, the transport roller 8 is formed of a hollow aluminum alloy sleeve of 12 mm in external diameter, and is driven by means of a motor (not shown) in the direction of an arrow shown in the drawing. On the fixing film 2, a contact type or non-contact type thermistor like that in Embodiment 1 is provided to detect the surface temperature of the fixing film 2. In this Embodiment, a thermopile is used which is a non-contact type thermistor so that the film can be prevented from being scratched. The film temperature thus detected is successively fed back to a fixing electric-power source (not shown) to make on/off or PID control the halogen lamp, in accordance with which the radiant light is applied to the fixing film and transport roller surfaces to maintain the film surface to a stated temperature (165 to 180° C.).

The fixing film in this Embodiment is described below in detail with reference to FIG. 7. The same fixing belt of triple-layer construction as that in Embodiment 1 may also be used in this Embodiment. In this Embodiment, however, the fixing film is made up in four-layer construction to achieve further improvement in efficiency. As a base layer 2-1 of the fixing film, like the case of Embodiment 1, a layer may be used which has been formed in thin gage using a material having heat-resistant and radiation-transmitting properties, such as a polyimide, polyamide or aramid resin. In this Embodiment, a polyimide seamless tube of 0.2 mm in thickness is used as the base layer (base material) 2-1. Since any glass materials such as heat-resistant glass or quartz glass as exemplified by pyrex, there is no danger of break or the like, and its fixing performance can be improved by applying pressure sufficiently.

Figure 7:
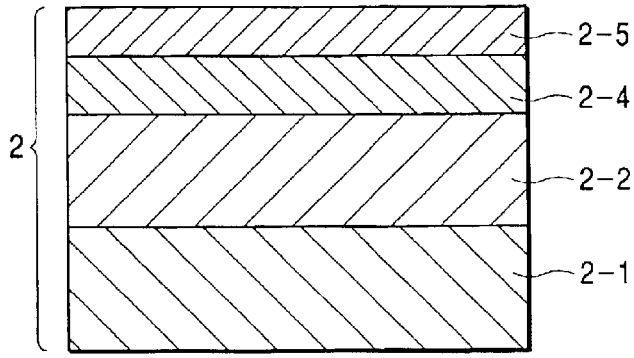
FIG. 7 illustrates an example of the construction of a fixing film in Embodiment 2.

In an intermediate layer 2-2 shown in FIG. 7, a transparent LTV silicone rubber having elasticity or a low-hardness fluorine resin may be used like that in Embodiment 1. However, in order to enhance surface heat response greatly and improve fixing performance, a material may preferably be used which has a thermal conductivity of less than 0.5 W/m·K, and more preferably 0.3 W/m·K or less. In this Embodiment, the intermediate layer 2-2 is formed using two-pack transparent LTV silicone rubber in a fillerless form, by roll coating. The intermediate layer 2-2 has a thermal conductivity of 0.3 W/m·K. A radiation-absorbing layer 2-4 which is further formed on the elastic layer may preferably be a layer having both elasticity and radiation-absorbing properties so that the properties of the underlying layer elastic layer are not lost. In the fixing film 2 used in this Embodiment, red iron oxide particles of 0.2 $\mu$m in particle diameter are dispersed in the same LTV silicone rubber as that used in the elastic layer, to form as the radiation-absorbing layer 2-4 a dark-brown LTV layer with a thermal conductivity of 1.0 W/m·K in a thickness of 50 μm. It has been ascertained that this layer almost completely absorbs the radiant light having been transmitted through the elastic layer and is able to perform surface heating efficiently without any heat loss outside the fixing member. In the present invention, the material is by no means limited to the above. In addition to, or in place of the red iron oxide, a metal oxide such as alumina or silica, or carbon black may appropriately be dispersed in the silicone rubber to improve radiation-absorbing properties and thermal conductivity. A method may also be used in which carbon coating material or the like is coated to form a radiation-absorbing layer, or a fluorine resin or polyimide sheet with iron oxide or carbon particles added internally thereto is thermally compression bonded to the elastic layer.

A release layer 2-5 which is a surface layer is formed on the radiation-absorbing layer. In this Embodiment, FEP fluorine resin is used to achieve an improvement in releasability compared with Embodiment 1, without incorporating any carbon black in the fluorine resin. The fluorine resin layer 2-5 may be formed in a thickness of approximately from 10 μm to 15 μm using an FEP resin or the like. The radiation-absorbing layer 2-4 may be formed in a thickness of approximately from 10 μm to 60 μm using a black LTV silicone rubber, a fluorine rubber latex or a carbon paste coating material, or a black-color tube or film material.

The fixing member having the form of a film (tubular film) of this Embodiment, formed as described above, consists of a 200 μm thick polyimide film base layer, a 500 μm thick transparent LTV silicone rubber intermediate layer, a 50 μm thick LTV silicone rubber radiation-absorbing layer with red iron oxide dispersed therein, and a 10 μm thick FEP fluorine resin surface layer.

Function-separating the surface-side layer into a layer having releasability and a layer having radiation-absorbing properties, as shown in FIG. 7, the fluorine resin layer 2-5 is formed at the surface and the radiation-absorbing layer 2-4 having an elasticity is provided beneath it. Thus, the function is separated into two layers so that the effect can be improved individually (releasability and radiation-absorbing properties).

Figure 8:
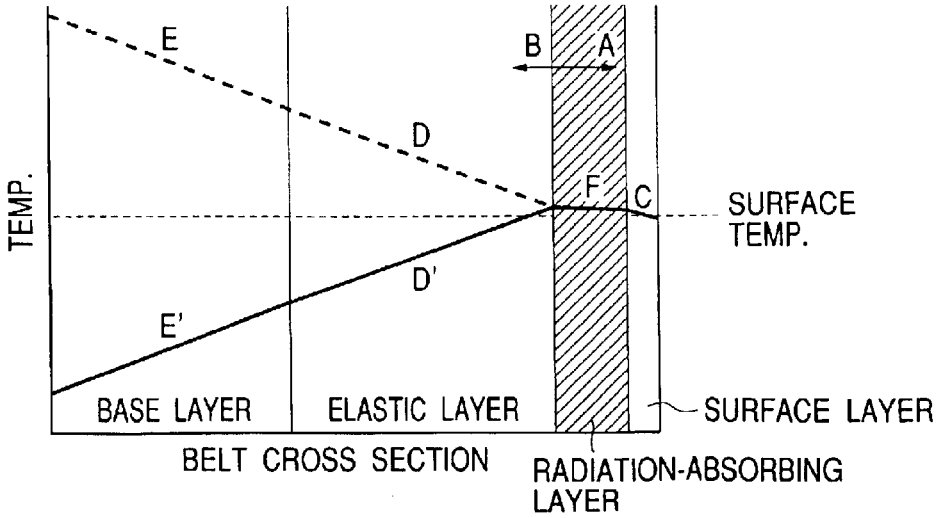
FIG. 8 is a view showing a difference between the temperature distribution of surface heating in the sectional direction of a fixing film in Embodiment 2 and the temperature distribution of inner-face heating of the same film but provided with a black-color absorbing layer on the back of the like film.

In respect of the fixing film 2 of surface heating as used in this Embodiment and a fixing film of inner-face heating which is constructed in the same manner as in this Embodiment except that the dark-brown radiation-absorbing layer is provided on the back (inner face) of the fixing film 2, a difference in temperature distribution between them in their sectional directions has also been examined. Results obtained are shown in FIG. 8. The temperature distribution of inner-face heating in the state (C) that the surface temperature of the surface layer 2-3 of the fixing film has come equal as a result of stationary radiation can be so made that, as shown by a solid line in FIG. 8, the temperature at the surface layer (C) and radiation-absorbing layer (F) is highest and the temperature at the intermediate layer (D') and that at the base layer (E') are lower. On the other hand, in the conventional inner-face heating system shown by a broken line in FIG. 8, the inner-face temperature at the elastic layer (D) and that at the base layer (E) comes higher than that at the surface layer (C) and radiation-absorbing layer (F). Hence, the rubber forming the elastic layer, and any adhesive at the interface may thermally deteriorate to shorten the lifetime of the assembly.

In the surface heating in this Embodiment, any influence of the inner-face temperature (D, E) can be made small, and hence the thickness of the base layer and that of the elastic layer can relatively arbitrarily be set. Accordingly, the base layer and the elastic layer may be formed in larger thickness to improve strength or to improve image uniformity. Here, the base layer and the elastic layer may each be in a thickness of 0.5 mm or less in order to transmit the radiant light and obtain the effect of the present invention.

The radiation-absorbing layer (F) may also be made to have a thermal conductivity (1.0 W/m·K) higher than the thermal conductivity (0.2 W/m·K) of the elastic layer (D) so that the heat flow (A) on the surface layer side can be greater than the heat flow (B) to the inner face. This makes it possible to efficiently transmit to the belt surface the heat conducted to or stored at the interface between the elastic layer and the radiation-absorbing layer.

Here, the radiation-absorbing layer may preferably have a thermal conductivity of 0.5 W/m·K or more, and more preferably 1 W/m·K or more. Thus, the surface layer can quickly be heated also when the radiation-absorbing layer is formed in a large thickness to improve absorbance. In addition, since the fixing film can be improved in thermal conductivity in the axial direction, any temperature rise at end portions can also be more prevented when small-sized paper sheets are continuously fed.

(Embodiment 3)

In this Embodiment, the fixing assembly is so constructed that the fixing belt is pressed against the back-up roller through a light-transmitting press member at the nip. Its construction is schematically cross-sectionally shown in FIG. 9. A fixing belt 2 having the same construction as the one used in Embodiment 1 is pressed between a light-transmitting press member 10 disposed on the back side of the belt and a back-up roller 3 having the same construction as the one used in Embodiment 1 so that toner images are fixed interposing the image-fixing medium such as paper sheet between the fixing belt 2 and the back-up roller 3. The light-transmitting press member 10 used in this Embodiment may be made of a material having heat-resistant and radiation-transmitting properties such as a polyimide, polyamide or aramid resin, and besides a glass material such as heat-resistant glass as exemplified by pyrex, or quartz glass, or a light-transmitting ceramic material. A material having high radiation-transmitting properties in the infrared wavelength region in addition to the visible wavelength region may be more preferred. The light-transmitting press member 10 may preferably have the form of a plate of 1 mm to several mm in thickness so that the image-fixing medium such as paper sheet can firmly be held between it and the back-up roller 3 at the nip under application of pressure. In this Embodiment, an inexpensive heat-resistant glass (pyrex) having a small coefficient of thermal expansion and a high resistance to thermal impulse is used as the light-transmitting press member 10. Also, in this Embodiment, since the fixing belt is rotated, the heat-resistant glass as the press member is set stationary, and may less break during drive than a glass roller. It is also platelike and can be formed with precision, and hence it can be prepared with ease to enable cost reduction.

Figure 9:
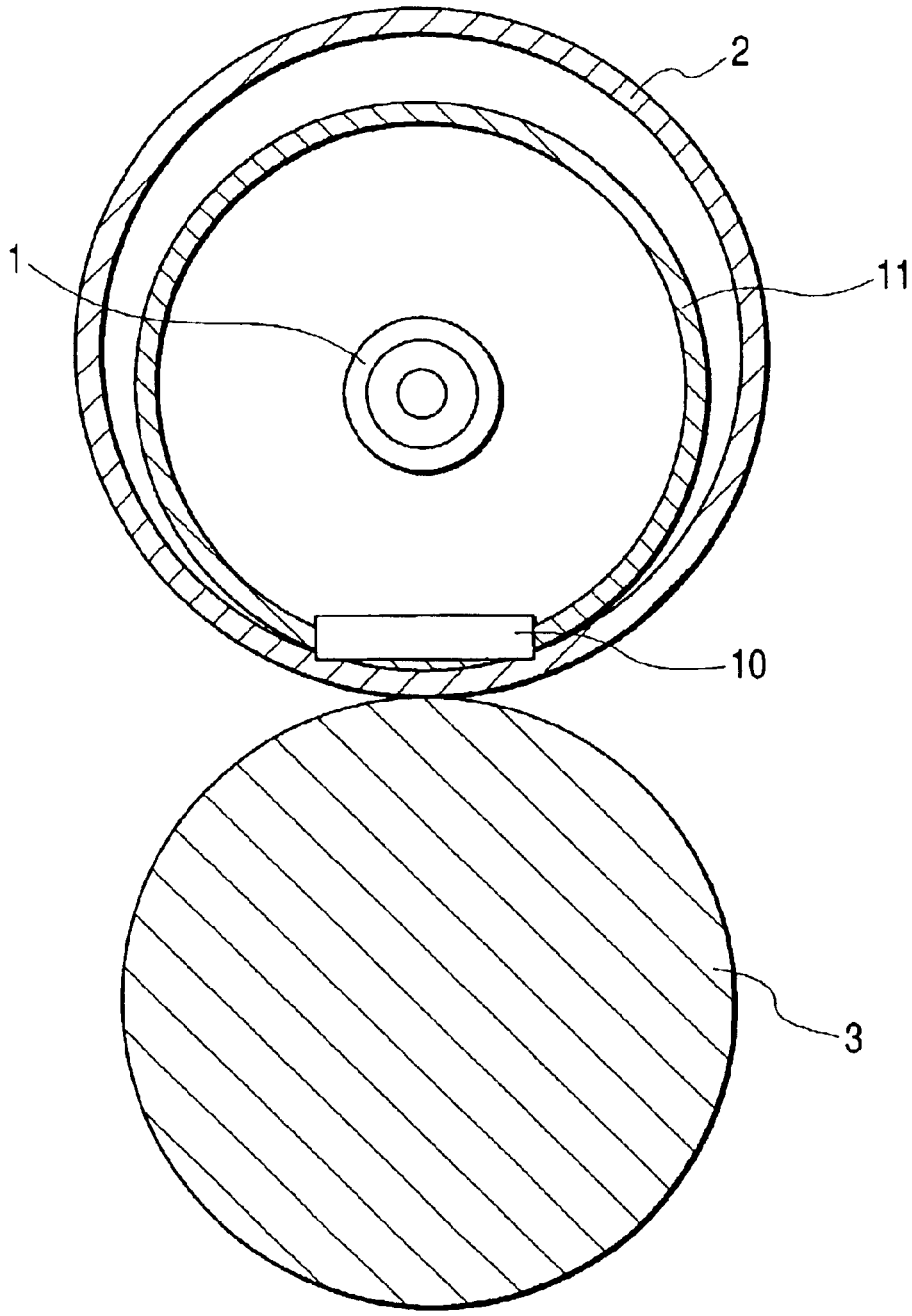
FIG. 9 illustrates the whole construction of a fixing assembly according to a third embodiment of the present invention as Embodiment 3.

In this Embodiment, as shown in FIG. 9, a guide member 11 is provided on the inner face of the fixing belt 2, and the fixing belt 2 is kept at proper distance from a heat-generating source halogen lamp 1 so that the former's temperature may not exceed its heat resistance temperature. As a material of the guide member 11, a light-transmitting mica sheet may be used, for example. If necessary, the guide member 11 may be reinforced with rib-shaped mica sheets at its plurality of portions in the axial direction, whereby its proper strength can be ensured. In this case, the fixing belt 2 is heated at its portion other than the part at the nip, so that the heat is stored also in the intermediate layer, base layer and so forth which are portions having a large heat capacity in the belt 2. Thus, when toner images are fixed to the image-fixing medium at the nip, the heat is dissipated together with the surface heating by radiation, and hence the action of more improving the fixing performance is attained. Also, a reflecting layer, e.g., an aluminum coat may be provided on the inner face, whereby the proportion of direct radiation to the nip can be made higher. However, corresponding to such proportion, the effect of heat storage at the part other than the nip may be expected with difficulty.

To make temperature control, a thermistor (not shown) may be brought into contact with the surface portion on the side against which the light-transmitting press member 10 is pressed, at the nip and in its paper feed or paper non-feed zone extending in the lengthwise direction, to detect temperature at this part, and the amount of radiation on the fixing belt 2 may be regulated to make PID control so that the surface of the fixing belt 2 is kept at a constant temperature. In place of the contact type thermistor, a non-contact type temperature-detecting member such as a thermopile may also be used.

What is claimed is:

1. A fixing member used to fix toner images, having the form of a film or belt which is multi-layer constructed to have at least a base layer, an intermediate layer and a surface layer, wherein, said base layer is formed of a material having radiation-transmitting properties, capable of transmitting radiation coming from a radiation source disposed on the back side of said base layer in non-contact with the fixing member;

said surface layer or intermediate layer is formed of a material having radiation-absorbing properties; and said base layer comprises a seamless tube having a thickness of from 0.01 mm to 0.5 mm.

2. The fixing member according to claim 1, wherein said surface layer is formed of a material having releasability.

3. The fixing member according to claim 1, wherein said intermediate layer is formed of a material having elasticity and radiation-transmitting properties.

4. The fixing member according to claim 1, wherein said base layer is formed of a material containing at least one of a polyimide resin, a polyamide resin and an aramid resin.

5. The fixing member according to claim 1, wherein said radiation source is a radiation source from which infrared light with wavelengths of from 0.7 $\mu$m to 5 $\mu$m is radiated.

6. The fixing member according to claim 1, wherein said base layer has a radiation transmittance of not less than 30% to infrared light with wavelengths of from 0.7 $\mu$m to 5 $\mu$m.

7. The fixing member according to claim 1, wherein said base layer has a radiation transmittance of not less than 50% to infrared light with wavelengths of from 0.7 $\mu$m to 5 $\mu$m.

8. The fixing member according to claim 1, wherein said base layer has a radiation transmittance of not less than 80% to infrared light with wavelengths of from 0.7 $\mu$m to 5 $\mu$m.

9. The fixing member according to claim 1, wherein said surface layer is formed of a fluorine resin to which a material having radiation-absorbing properties has been added.

10. The fixing member according to claim 1, wherein said intermediate layer is formed of a silicone rubber.

11. The fixing member according to claim 1, wherein said fixing member used to fix toner images, having the form of a film or belt with multi-layer construction consists at least of a base layer having radiation-transmitting properties, an intermediate layer having radiation-transmitting properties, a radiation-absorbing layer, and a surface layer having releasability.

12. The fixing member according to claim 11, wherein said radiation-absorbing layer has a thermal conductivity higher than the thermal conductivity of said intermediate layer having radiation-transmitting properties and that of said base layer having radiation-transmitting properties.

13. The fixing member according to claim 11, wherein said radiation-absorbing layer has a thermal conductivity which is higher by 0.7 W/m·K or more, than the thermal conductivity of said intermediate layer.

14. The fixing member according to claim 1, wherein said base layer has a thermal conductivity of less than 0.5 W/m·K.

15. The fixing member according to claim 1, wherein said base layer and said intermediate layer each have a thermal conductivity of less than 0.5 W/m·K.

16. The fixing member according to claim 1, wherein said radiation source is selected from the group consisting of a halogen lamp, a carbon lamp and a xenon lamp.

17. The fixing member according to claim 1, wherein said surface layer is formed by coating with a coating material prepared by dispersing carbon particles with an average particle diameter of 0.1 $\mu$m or less, having radiation-absorbing properties, in a fluorine resin of fluorinated ethylene propylene, having heat resistance and releasability.

18. The fixing member according to claim 1, wherein said surface layer has a thermal conductivity which is higher by 0.4 W/m·K or more, than the thermal conductivity of said intermediate layer.

19. A fixing member used to fix toner images, having the form of a film or belt which is multi-layer constructed to have at least a base layer, an intermediate layer, and a surface layer, wherein, said base layer is formed of a material having radiation-transmitting properties, capable of transmitting radiation coming from a radiation source disposed on the back side of said base layer in non-contact with the fixing member;

said surface layer or intermediate layer is formed of a material having radiation-absorbing properties; and said surface layer has a thermal conductivity of 0.5 W/m·K or more.

20. A fixing member used to fix toner images, having the form of a film or belt which is multi-layer constructed to have at least a base layer, an intermediate layer, and a surface layer, wherein, said base layer is formed of a material having radiation-transmitting properties, capable of transmitting radiation coming from a radiation source disposed on the back side of said base layer in non-contact with the fixing member;

said surface layer or intermediate layer is formed of a material having radiation-absorbing properties; and said surface layer has a thermal conductivity higher than the thermal conductivity of said base layer.

21. A fixing assembly for fixing toner images to an image-fixing medium, said assembly comprising:

a fixing member used to fix toner images, having the form of a film or belt which is multi-layer constructed to have at least a base layer, an intermediate layer and a surface layer;

a press member disposed opposingly to the fixing member; and a radiation source disposed on the back side of the base layer of said fixing member, wherein the surface layer or its vicinity of said fixing member is heated by radiation coming from said radiation source, and is pressed, at the time the image-fixing medium passes through a fixing nip formed between said fixing member and said press member;

said base layer is formed of a material having radiation-transmitting properties, capable of transmitting radiation coming from a radiation source disposed on the back side of said base layer in non-contact with the fixing member;

said surface layer or intermediate layer is formed of a material having radiation-absorbing properties; and said base layer comprises a seamless tube having a thickness of from 0.01 mm to 0.5 mm.

22. The fixing assembly according to claim 21, wherein said surface layer is formed of a material having releasability.

23. The fixing assembly according to claim 21, wherein said intermediate layer is formed of a material having elasticity and radiation-transmitting properties.

24. The fixing assembly according to claim 21, wherein said base layer is formed of a material containing at least one of a polyimide resin, a polyamide resin and an aramid resin.

25. The fixing assembly according to claim 21, wherein said radiation source is a radiation source from which infrared light with wavelengths of from 0.7 $\mu$m to 5 $\mu$m is radiated.

26. The fixing assembly according to claim 21, wherein said base layer has a radiation transmittance of not less than 30% to infrared light with wavelengths of from 0.7 $\mu$m to 5 $\mu$m.

27. The fixing assembly according to claim 21, wherein said base layer has a radiation transmittance of not less than 50% to infrared light with wavelengths of from 0.7 $\mu$m to 5 $\mu$m.

28. The fixing assembly according to claim 21, wherein said base layer has a radiation transmittance of not less than 80% to infrared light with wavelengths of from 0.7 $\mu$m to 5 $\mu$m.

29. The fixing assembly according to claim 21, wherein said surface layer is formed of a fluorine resin to which a material having radiation-absorbing properties has been added.

30. The fixing assembly according to claim 21, wherein said intermediate layer is formed of a silicone rubber.

31. The fixing assembly according to claim 21, wherein said fixing member used to fix toner images, having the form of a film or belt with multi-layer construction consists at least of a base layer having radiation-transmitting properties, an intermediate layer having radiation-transmitting properties, a radiation-absorbing layer, and a surface layer having releasability.

32. The fixing assembly according to claim 31, wherein said radiation-absorbing layer has a thermal conductivity higher than the thermal conductivity of said intermediate layer having radiation-transmitting properties and that of said base layer having radiation-transmitting properties.

33. The fixing assembly according to claim 31, wherein said radiation-absorbing layer has a thermal conductivity which is higher by 0.7 W/m·K or more, than the thermal conductivity of said intermediate layer.

34. The fixing assembly according to claim 21, wherein said base layer has a thermal conductivity of less than 0.5 W/m·K.

35. The fixing assembly according to claim 21, wherein said base layer and said intermediate layer each have a thermal conductivity of less than 0.5 W/m·K.

36. The fixing assembly according to claim 21, wherein said radiation source is selected from the group consisting of a halogen lamp, a carbon lamp and a xenon lamp.

37. The fixing assembly according to claim 21, wherein said surface layer is formed by coating with a coating material prepared by dispersing carbon particles with an average particle diameter of 0.1 $\mu$m or less, having radiation-absorbing properties, in a fluorine resin of fluorinated ethylene propylene, having heat resistance and releasability.

38. The fixing assembly according to claim 21, wherein said surface layer has a thermal conductivity which is higher by 0.4 W/m·K or more, than the thermal conductivity of said intermediate layer.

39. A fixing assembly for fixing toner images to an image-fixing medium, said assembly comprising:

a fixing member used to fix toner images, having the form of a film or belt which is multi-layer constructed to have at least a base layer, an intermediate layer and a surface layer;

a press member disposed opposingly to the fixing member; and a radiation source disposed on the back side of the base layer of said fixing member, wherein the surface layer or its vicinity of said fixing member is heated by radiation coming from said radiation source, and is pressed, at the time the image-fixing medium passes through a fixing nip formed between said fixing member and said press member;

said base layer is formed of a material having radiation-transmitting properties, capable of transmitting radiation coming from a radiation source disposed on the back side of said base layer in non-contact with the fixing member;

said surface layer or intermediate layer is formed of a material having radiation-absorbing properties; and said surface layer has a thermal conductivity of 0.5 W/m·K or more.

40. A fixing assembly for fixing toner images to an image-fixing medium, said assembly comprising:

a fixing member used to fix toner images, having the form of a film or belt which is multi-layer constructed to have at least a base layer, an intermediate layer and a surface layer;

a press member disposed opposingly to the fixing member; and a radiation source disposed on the back side of the base layer of said fixing member, wherein the surface layer or its vicinity of said fixing member is heated by radiation coming from said radiation source, and is pressed, at the time the image-fixing medium passes through a fixing nip formed between said fixing member and said press member;

said base layer is formed of a material having radiation-transmitting properties, capable of transmitting radiation coming from a radiation source disposed on the back side of said base layer in non-contact with the fixing member;

said surface layer or intermediate layer is formed of a material having radiation-absorbing properties; and said surface layer has a thermal conductivity higher than the thermal conductivity of said base layer.

* * * * *

UNITED STATES PATENT AND TRADEMARK OFFICE

CERTIFICATE OF CORRECTION

PATENT NO. : 6,785,506 B2
DATED : August 31, 2004
INVENTOR(S) : Motoi Kato et al.

It is certified that error appears in the above-identified patent and that said Letters Patent is hereby corrected as shown below:

Column 2,
Line 37, “tends” should read -- it tends --.
Line 41, “smooth” should read -- smoother --.
Line 57, “can not” should read -- cannot --.

Column 6,
Line 33, “It” should read -- If --.

Column 7,
Line 31, “may” should read -- may be --.

Signed and Sealed this

Seventh Day of December, 2004

JON W. DUDAS
*Director of the United States Patent and Trademark Office*